United States Patent [19]

Thompson

[11] Patent Number: 4,912,868

[45] Date of Patent: Apr. 3, 1990

[54] MUZZLE LOADING CONVERSION UNIT FOR SHOTGUNS

[76] Inventor: Earl E. Thompson, 33 Navajo Rd., Brunswick, Ga. 31520

[21] Appl. No.: 350,448

[22] Filed: May 11, 1989

[51] Int. Cl.[4] ..... F41C 21/22

[52] U.S. Cl. ..... 42/77; 42/51

[58] Field of Search ..... 42/77, 90, 51

[56] References Cited

U.S. PATENT DOCUMENTS

| | | | |
|---|---|---|---|
| 230,224 | 7/1880 | Beebe | 42/77 |
| 685,751 | 11/1901 | Edge | 42/77 |
| 990,575 | 4/1911 | Marble | 42/77 |
| 1,661,949 | 3/1928 | Krenek | 42/77 |
| 3,780,464 | 12/1973 | Anderson | 42/51 |
| 4,232,468 | 11/1980 | Chapin | 42/77 |
| 4,519,156 | 5/1985 | Shaw | 42/77 |

FOREIGN PATENT DOCUMENTS

| | | | |
|---|---|---|---|
| 0159970 | 10/1985 | European Pat. Off. | 42/77 |

*Primary Examiner*—David H. Brown

*Attorney, Agent, or Firm*—Fleit, Jacobson, Cohn, Price, Holman & Stern

[57] ABSTRACT

A conversion unit for a firearm including a barrel assembly which replaces a standard shotgun barrel used on the type of shotguns that utilize quick change barrels which enables an existing shotgun to be converted into a muzzle loading rifle. The conversion is accomplished without affecting normal operation of the shotgun thereby enabling the muzzle loading conversion unit of this invention to be removed and replaced by the previously removed shotgun barrel. The muzzle loading conversion unit includes a barrel that has the same general outside dimensions as the standard replacement shotgun barrel with the conversion barrel including rifling and adjustable sights with the breech end being provided with a plug that is chambered to accept a standard shotshell primer with the breech plug also having a spring loaded extractor which will extract the spent shotshell primer a short distance. The underside of the conversion barrel is provided with two lugs that are drilled to accept a ramrod in alignment with the existing magazine cap which is modified by providing a passageway receiving the ramrod which passes through the magazine cap, the magazine tube and is secured to a threaded stud affixed to the inside of the magazine follower.

7 Claims, 1 Drawing Sheet

MUZZLE LOADING CONVERSION UNIT FOR SHOTGUNS

BACKGROUND OF THE INVENTION

1. Field of the Invention

The present invention is a conversion unit for a firearm and more particularly a barrel assembly which replaces a standard shotgun barrel used on the type of shotguns that utilize quick change barrels which enables an existing shotgun to be converted into a muzzle loading rifle. The conversion is accomplished without affecting normal operation of the shotgun thereby enabling the muzzle loading conversion unit of this invention to be removed and replaced by the previously removed shotgun barrel. The muzzle loading conversion unit includes a barrel that has the same general outside dimensions as the standard replacement shotgun barrel with the conversion barrel including rifling and adjustable sights with the breech end being provided with a plug that is chambered to accept a standard shotshell primer with the breech plug also having a spring loaded extractor which will extract the spent shotshell primer a short distance. The underside of the conversion barrel is provided with two lugs that are drilled to accept a ramrod in alignment with the existing magazine cap which is modified by providing a passageway receiving the ramrod which passes through the magazine cap, the magazine tube and is secured to a threaded stud affixed to the inside of the magazine follower.

2. Information Disclosure Statement

Devices have been previously provided to enable a breech loading firearm to be converted to a muzzle loading firearm. The following U.S. patents are relevant to this concept.

U.S. Pat. Ser. No. 230,224
U.S. Pat. No. 4,222,191
U.S. Pat. No. 4,227,330
U.S. Pat. No. 4,232,468
U.S. Pat. No. 4,437,249

The prior art devices such as shown in the above patents are usually in the form of breech plugs insertable into an existing shotgun barrel breech. None of the above patents disclose the structural arrangement and concepts of this invention.

SUMMARY OF THE INVENTION

An object of the present invention is to provide a conversion unit for converting an existing slide action or semiautomatic shotgun to a muzzle loading rifle by removing the existing shotgun barrel and replacing it with a rifle barrel having a breech end chambered to receive a standard shotshell primer and provided with an extractor for a spent primer.

Another object of the invention is to provide a conversion unit in accordance with the preceding object in which the function of the shotgun is not affected by the conversion unit and only minor modifications are made in the shotgun thereby enabling the firearm to be rapidly and easily changed from an existing conventional shotgun to a muzzle loading rifle with the assembly then being just as easily changed back to a shotgun.

A further object of the invention is to provide a conversion unit in accordance with the preceding objects in which the replacement barrel includes spaced underlugs receiving the ramrod for storage purposes with the magazine cap and follower of the shotgun being modified with the cap including an aperture receiving the end of the ramrod and the follower including a threaded stud affixed thereto to which the end of the ramrod can be connected to retain it in stored position in underlying relation to the barrel.

Still another object of this invention is to provide a conversion unit in accordance with the preceding objects in which the assembly is safe to use in both modes of operation and can be quickly and easily converted from one mode to the other and back to the original mode of operation and which involves only minor alterations to the existing standard shotgun structure which do not adversely affect operation of the existing shotgun when it is converted back to use as a shotgun.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
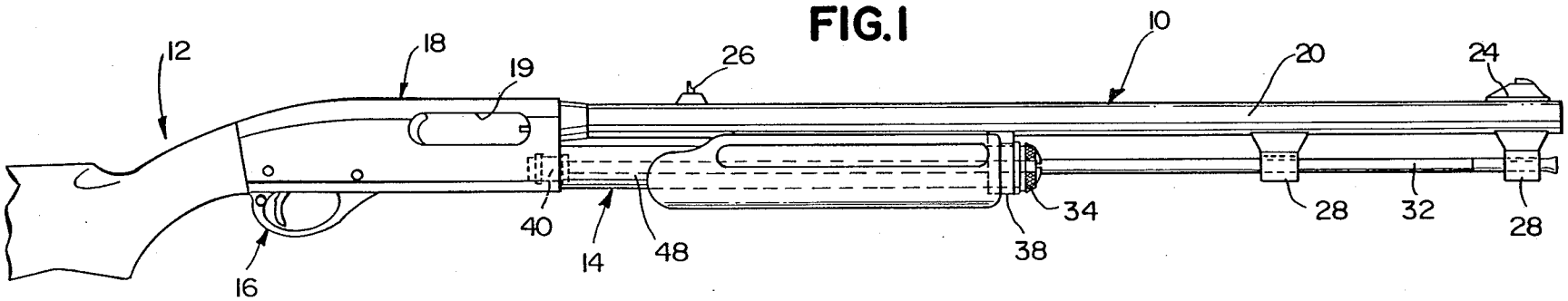
FIG. 1 is a side elevational view of the muzzle loading conversion unit of the present invention assembled with existing components of a slide action or semiautomatic shotgun by which the shotgun has been converted to a muzzle loading rifle.
Figure 2:
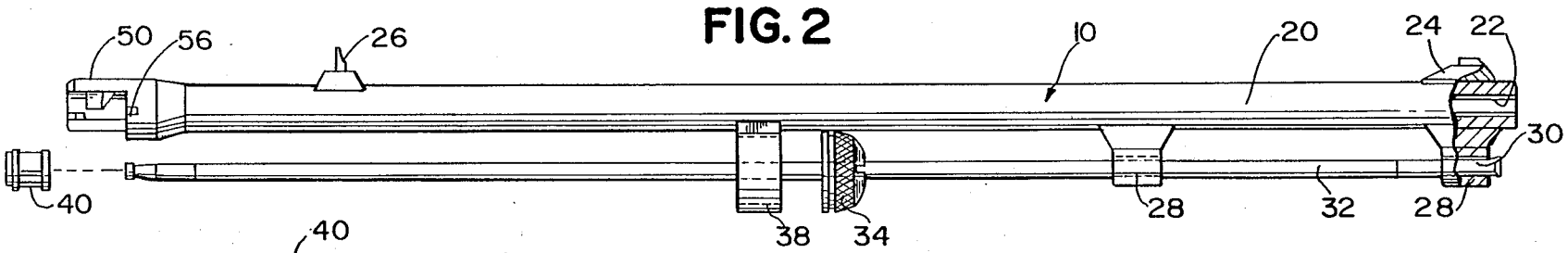
FIG. 2 is a side elevational view of the replacement barrel and ramrod with certain of the components of the shotgun being illustrated in association with the ramrod.
Figure 7:
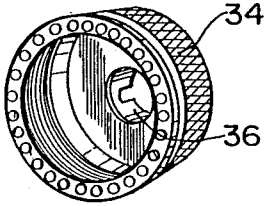
FIG. 7 is a perspective view of the magazine end cap illustrating the aperture formed therein for receiving the ramrod.
Figure 5:
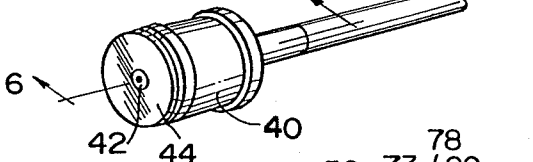
FIG. 5 is a perspective view of the end of the ramrod and magazine follower.

Referring now specifically to the drawings, the conversion unit of the present invention is generally designated by the numeral 10 and is illustrated in association with the stock 12, magazine 14, trigger mechanism 16 and receiver 18 of a standard slide action or semiautomatic shotgun with the embodiment illustrated in FIG. 1 being a Model 870 shotgun manufactured by Remington Arms Co.

The conversion unit 10 includes an elongated barrel 20 having a bore 22 extending therethrough of the desired caliber and provided with rifling in a conventional manner with a front sight 24 and a rear sight 26 which may be adjustable. The dimensional characteristics of the barrel 20 are substantially the same as the existing shotgun barrel as to the outside diameter and structural features which enable it to be connected to the existing shotgun structure in the same manner as the existing quick change shotgun barrel thus enabling the existing shotgun barrel to be removed from the other components of the shotgun and the barrel 20 of this invention attached to the existing shotgun structure in lieu of the removed quick change barrel without any modification whatsoever of the existing shotgun. The barrel 20 includes a pair of underlugs or depending lugs 28 mounted thereon which are in alignment with the barrel and provided with a bore 30 extending therethrough for receiving a ramrod 32. The forwardmost underlug should be approximately ¾" from the end of the barrel 20 and the rearward lug 28 should be between the forward lug 28 and a magazine cap 34. The cap 34 is conventional except that a hole 36 has been provided in the center thereof for receiving the ramrod 32 which also extends through a barrel ring 38 and is connected to the magazine follower 40 which is conventional except for the provision of a threaded stud 42 in the center portion of the inner end wall 44 with the threaded stud being threadedly engaged with an internal threaded bore 46 in the end of the ramrod 32. The ramrod is in the form of an elongated shaft approximately ⅜" in diameter and 24" long and can be made of wood, metal, plastic or a combination of materials. The internally threaded bore 46 receives standard cleaning and reloading accessories when the gun is being muzzle loaded. Threadedly engaging the end of the ramrod 32 with the magazine follower 40 retains the ramrod in place as it extends through the magazine cap 34, ring 38, magazine tube 48 and into the magazine follower 40 with the magazine follower being held in place by the magazine spring (not shown).

Figure 4:
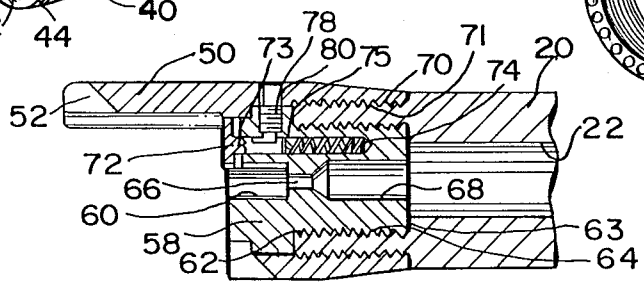
FIG. 4 is a sectional view taken substantially upon a plane passing along section line 4—4 on FIG. 3 illustrating specific structural details of the breech end of the replacement barrel.
Figure 6:
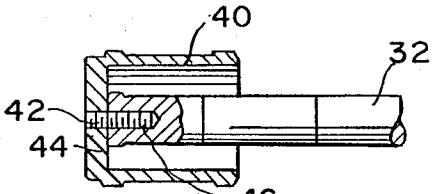
FIG. 6 is a detailed sectional view taken substantially upon a plane passing along section line 6—6 on FIG. 5 illustrating further structural details of the connection between the ramrod and magazine follower.

The inner end of the barrel 20 includes a projecting semicylindrical hood 50 which is the same as the hood on the existing shotgun barrel and includes an end notch 52 and a tapering peripheral recess 54 on the inner surface thereof as well as a notch 56 on the end of the barrel peripherally spaced from the hood 50. The breech end of the barrel 20 is provided with a breech plug 58 that is chambered at 60 to receive a shotshell primer (not shown). The interior of the breech end 20 of the barrel is internally threaded at 62 to receive an externally threaded portion 64 of the plug 58. As illustrated in FIG. 4, there is a passageway 66 communicating the chamber 60 with the interior powder chamber 68 which receives the powder charge in a manner set forth hereinafter. Also, the barrel hood 50 is internally threaded at 70 to engage a recessed externally threaded portion 71 of the barrel 20.

Figure 3:
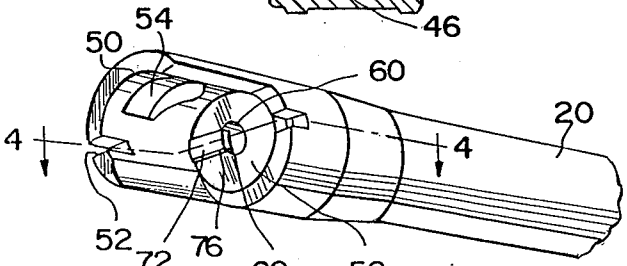
FIG. 3 is a perspective view of the breech end of the replacement barrel.

The plug 58 also includes an extractor 72 having a mounting pin 73 and an extractor spring 74 received in a bore 75 and retained therein by a set screw 78 accessible through hole 80 to enable restricted resilient movement of the extractor 72 which has an end portion 82 that is curved to fit the exterior periphery of the primer immediately inwardly of the flange on the primer whereby the spring 74 and extractor 72 will extract the primer a short distance, approximately 1/16", when the bolt is retracted in the receiver. When the plug and extractor have been assembled onto the barrel along with the hood, only the rear face of the plug 58 and the extractor 72 are visible along with the chamber 60 as illustrated in FIG. 3 and the breech plug is locked in place by the hood. The rear surface of the breech plug 58 includes a radial recess 76 milled to a depth to receive the extractor 72 and a hole or bore 75 is drilled into the breech plug to receive the extractor spring 74 and the mounting pin 73 on the extractor which is notched to receive the inner end of the set screw 78 with the notch enabling the extractor to move only approximately 1/16" so that the extractor will at all times stay within the milled notch or recess 76 formed in the rear face of the plug. A hole 80 is drilled in the barrel hood to allow access to the set screw 78 to enable disassembly of the extractor without removing the barrel hood. The breech plug 58 may be assembled into the barrel by the use of a spanner wrench with appropriate holes or recesses being provided to enable the spanner wrench to engage the plug with the plug being seated against the internal shoulder 63 at the inner end of the internal threads 62 in the barrel in order to provide a proper gas seal.

In use, the shotgun is modified by installation of the modified magazine follower 40. The replacement barrel 10 is then installed and secured by installation of the modified magazine cap 34. The ramrod is passed through the barrel underlugs, aperture 36 in the magazine cap 34 and screw threadedly secured onto the threaded stud 42 in the magazine follower. The modified firearm which is now a muzzle loading rifle is ready to be loaded by holding the muzzle end of the barrel in an upright position and pouring a measured charge of black gunpowder down the barrel after which a projectile is placed in the barrel and pushed down onto the powder charge with the ramrod in a conventional and well-known manner. The action of the firearm is opened in the normal way which provides access to the breech plug 58 through the ejection port 19 and a shotshell primer of standard shape and configuration and size is placed into the chamber 60 and is held to the rear approximately 1/16" by the spring loaded extractor 72. The action of the firearm is then closed and locked by the original locking mechanism of the shotgun with locking of the breech bolt in closed position pushing both the primer and the spring loaded extractor 72 flush with the face of the breech plug 58. The safety is removed and the rifle is fired in a conventional manner by pulling the trigger which results in the firing pin striking the primer and forcing the flame through a small diameter hole or orifice 66 on the center line with the primer chamber 60 and through the breech plug into the powder charge. The action of the rifle is again opened which allows the spring loaded extractor 72 to push out the spent primer approximatley 1/16" with the spent primer being further extracted with a fingernail and discarded. The rifle is then ready for cleaning and reloading. When it is desired to convert the rifle back to normal shotgun use, this can be accomplished by simply replacing the conversion barrel with the original shotgun barrel and securing it with either the modified or the original magazine cap.

While the conversion unit of this invention has been disclosed in association with a Model 870 Remington slide action shotgun, it is fully capable of use with various shotguns having quick change barrels with the modifications of the existing shotgun assembly being relatively minor and easily accomplished and these modifications will not affect the function of these components when the conversion unit is removed and the shotgun is restored to its original function.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A conversion unit for a gun having a receiver, magazine, magazine follower, magazine end cap and a trigger mechanism comprising a rifle barrel, means on the rifle barrel for mounting the rifle barrel to the receiver and magazine, said rifle barrel including a bore extending therethrough and a breech plug in the breech end of the bore, said breech plug including a primer chamber adapted to receive a shotshell primer, a powder chamber adapted to receive a powder charge and a small passageway communicating the primer chamber with the powder chamber for igniting the powder charge therein when the primer is fired, said rifle barrel including means along the undersurface thereof for receiving a ramrod, said magazine end cap having an aperture receiving the ramrod, said magazine follower including a threaded stud threadedly engaged with one end of the ramrod to retain it detachably in mounted position underlying the rifle barrel to enable a powder charge and projectile to the loaded into the muzzle of the rifle barrel and rammed inwardly to muzzle load the rifle.

2. The structure as defined in claim 1 wherein said breech plug includes a spring loaded extractor adapted to engage a rim flange on a shotshell primer positioned in the chamber and adapted to extract the primer a limited distance.

3. The structure as defined in claim 2 wherein said means receiving the ramrod from the barrel includes a pair of underlugs rigidly connected with the barrel and including aligned apertures for receiving the ramrod.

4. The structure as defined in claim 3 wherein said rifle barrel includes a depending ring engaged with the end of the magazine and secured in position by the magazine end cap.

5. The structure as defined in claim 4 wherein said rifle barrel is internally threaded at the breech end with the breech plug being externally threaded for screw threaded engagement with the rifle barrel, said rifle barrel mounting means including a hood projecting from a portion of the periphery of the rifle barrel at the breech end for connection with the receiver.

6. The structure as defined in claim 5 wherein said rifle barrel includes sights and removable retaining means for the spring loaded extractor to enable the extractor to be removed for replacement.

7. The method of converting a slide action semiautomatic shotgun with a quick change barrel and having a magazine with a magazine follower and end cap to a muzzle loading rifle consisting of the steps of mounting a rifle barrel in exactly the same place as the shotgun barrel, providing an aperture in the magazine cap, providing a threaded stud on the magazine follower, providing underlug structure on the rifle barrel in alignment with the magazine cap and follower and inserting a ramrod through the underlug structure, the aperture in the magazine end cap and threading the ramrod to the stud on the follower.

* * * * *